US007163119B2

(12) United States Patent
Besselman

(10) Patent No.: US 7,163,119 B2
(45) Date of Patent: Jan. 16, 2007

(54) EXPANDABLE DIVIDER SYSTEM

(76) Inventor: Patricia Ann Besselman, 618 Kolpwood Ave., NW., Massillon, OH (US) 44646

( * ) Notice: Subject to any disclaimer, the term of this patent is extended or adjusted under 35 U.S.C. 154(b) by 336 days.

(21) Appl. No.: 10/788,829

(22) Filed: Feb. 28, 2004

(65) Prior Publication Data

US 2004/0188444 A1 Sep. 30, 2004

Related U.S. Application Data

(60) Provisional application No. 60/456,458, filed on Mar. 24, 2003.

(51) Int. Cl.

| | |
|---|---|
| ***B65D 1/24*** | (2006.01) |
| ***B65D 1/36*** | (2006.01) |
| ***B65D 25/04*** | (2006.01) |
| ***B65D 57/00*** | (2006.01) |

(52) U.S. Cl. ..... 220/551; 220/534

(58) Field of Classification Search ..... 229/120.33, 229/120.34; 220/529, 533, 534, 545, 551, 220/552; 312/205, 348.2, 348.3, 348.4; 190/109, 190/110

See application file for complete search history.

(56) References Cited

U.S. PATENT DOCUMENTS 1,677,544 A * 7/1928 Gourley et al. ..... 312/117
3,750,894 A * 8/1973 Jensen et al. ..... 211/184
3,954,202 A * 5/1976 Petrick ..... 220/533
4,595,246 A * 6/1986 Bross ..... 312/348.3
4,705,168 A * 11/1987 Ward ..... 206/373
4,889,253 A * 12/1989 Schmulian et al. ..... 220/551
5,242,223 A * 9/1993 Koves ..... 312/348.3
5,292,571 A * 3/1994 Quinn ..... 428/178
5,738,425 A * 4/1998 Rosenberg et al. ..... 312/348.3
5,913,473 A * 6/1999 Wang ..... 229/120.07
5,996,749 A * 12/1999 Hillsberg et al. ..... 190/109
6,073,794 A * 6/2000 Bidot ..... 220/529

* cited by examiner

*Primary Examiner*—Nathan J. Newhouse
*Assistant Examiner*—Harry Grosso

(57) ABSTRACT

Divider system for dividing drawers or the like in sections by means of using an individual divider or by attaching dividers together with a clip and expanding to the desired planar dimensions. Divider is one continuous piece with a main body and a perpendicular flange and is provided with a slot extending the length of the surface and the flange. The clips are inserter into the slots for attaching the dividers together end to end, perpendicular, and parallel allowing adjustability and expandability. A bifurcated clip provides tension to securely adjoin individual dividers.

7 Claims, 5 Drawing Sheets

EXPANDABLE DIVIDER SYSTEM

This application claims the benefit of U.S. Provisional Application No. 60/456,458, filed Mar. 24, 2003.

BACKGROUND OF INVENTION

It is desirable to divide drawers or the like but not limited to drawers into compartments or sections of variable size. Other divider systems are limited in that the components must be broken to construct the compartments, thus they cannot be reconfigured. Also, other divider systems are preconfigured and can only be utilized in similar sized drawers thereafter.

There is a need for a divider system that will expand to any size drawer or the like, can be reconfigured unlimited times without damage to or destruction of the dividers, and having the ability to form any desired configuration or compartments.

FIELD OF THE INVENTION

This invention, the Drawer Divider System, presents a unique method of dividing drawers or the like but not limited to drawers into various configurations by connecting the divider panels together having the capability of expanding to fit the desired dimensions.

SUMMARY

The invention is a Divider system for dividing drawers or the like in sections by the means of using an individual divider or by attaching dividers together with a clip and expanding to the desired planar dimension.

The main body is one continuous piece, paired with a perpendicular attachment flange and is provided with a lateral slot or slots extending the length of the surface but not completely to the end of the main body and the flange.

The divider is of a rectangular shape of various length and height with a main body and a flange on one end. The main body of the divider allows for a slot or multiple slots starting at equal distances from the left and right ends of the body of the divider. The slot allows for the connection of other dividers and the ability to slide and position the connecting divider along the slot. The length of the flange allows for a slot the dimensions of the clip.

The clips are inserted into the slots for attaching the dividers together flange to flange, perpendicular, and parallel allowing adjustability and expandability. A bifurcated clip provides tension to securely adjoin individual and multiple dividers. The system is designed to allow for multiple configurations.

Injection molds are used to form the divider and clip. The mold forms the clip to fit into the slots of the main body of the divider and on the perpendicular end of the divider referred to as the flange. The clip has a bifurcated design or the like with a flat surface and two protruding forks perpendicular to the flat surface which provide the outward tension and inward resistance necessary to join and secure the dividers and is molded as such.

DESCRIPTION OF THE PREFERRED EMBODIMENTS

Figure 1:
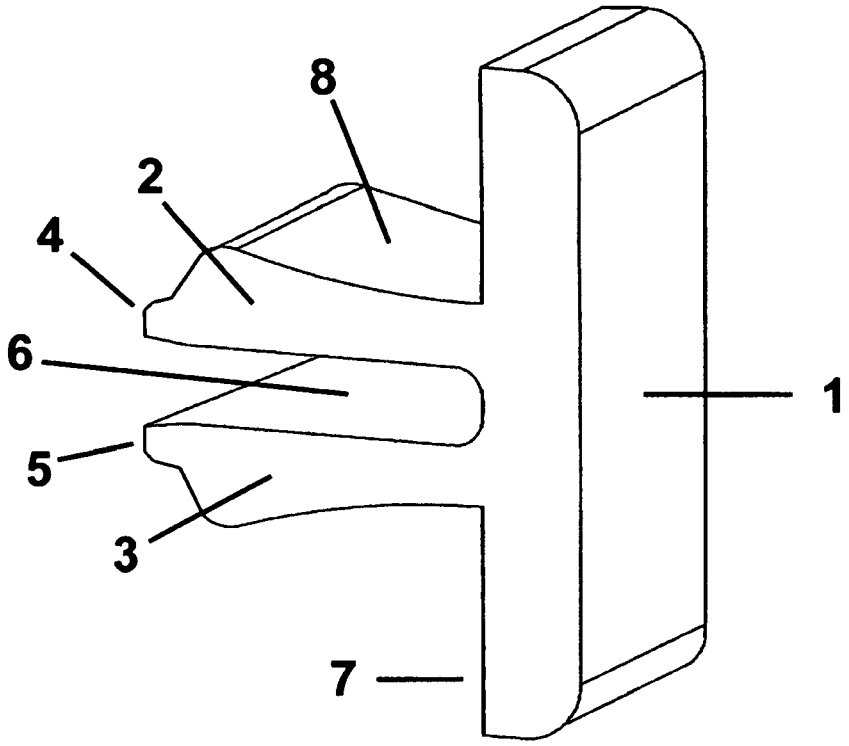
FIG. 1 is an isometric perspective view of a single bifurcated clip illustrating the flat surface of the clip and the two perpendicular protruding forks.
Figure 2:
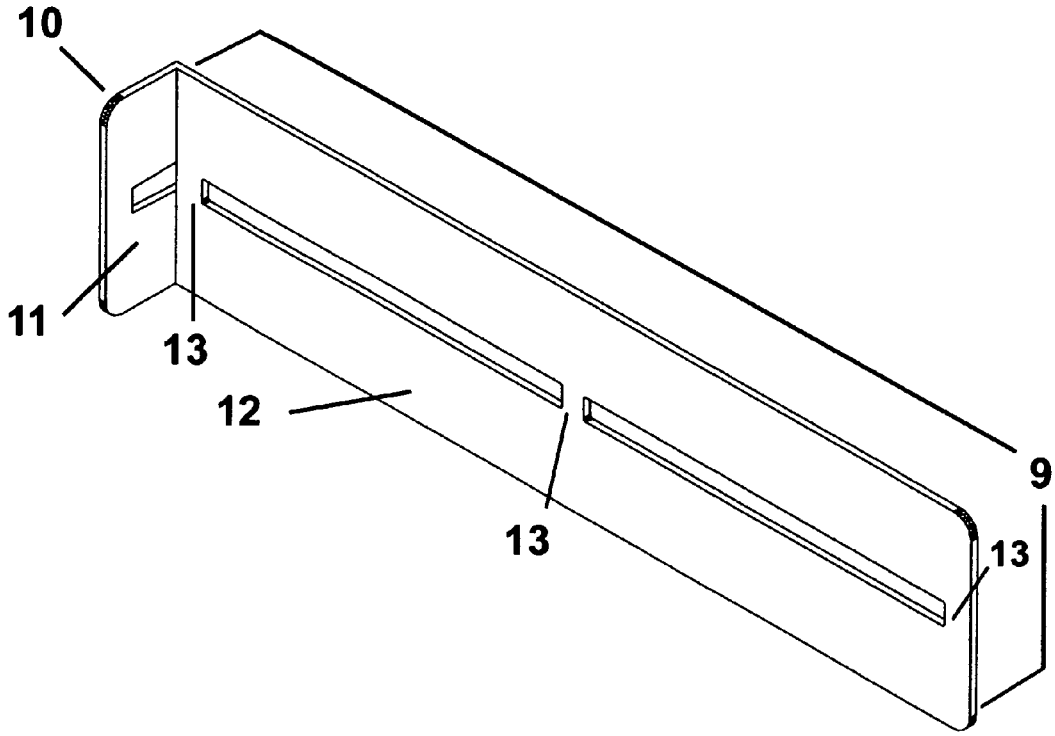
FIG. 2 is an isometric perspective view of a single divider illustrating the perpendicular attachment flange, dividers main body, and lateral slots.
Figure 3:
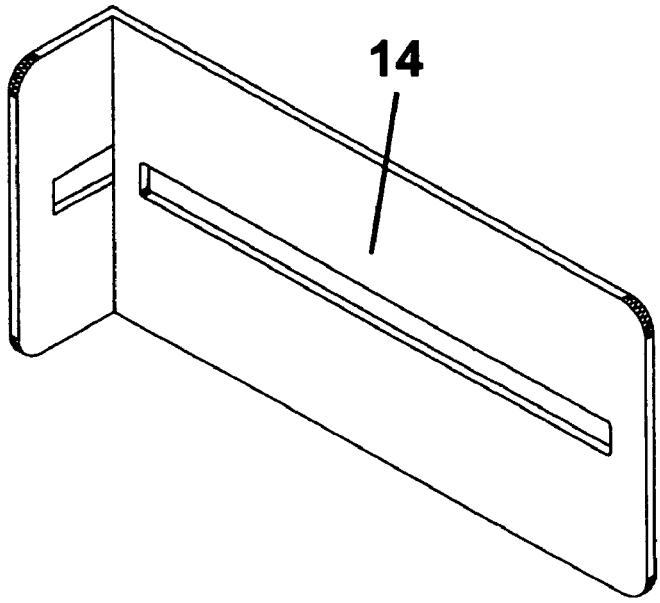
FIG. 3 is an isometric perspective view similar to FIG. 2, but showing a divider with a shorter main body and illustrating the perpendicular attachment flange, divider main body, and lateral slot.
Figure 4:
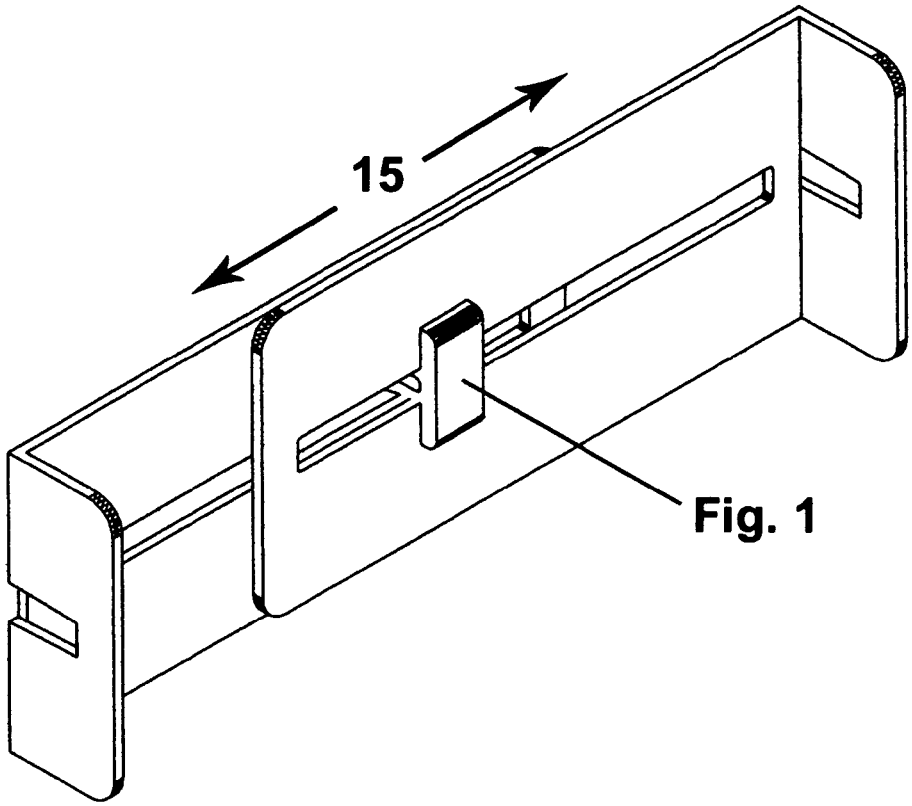
FIG. 4 is an isometric perspective view of two dividers joined in parallel connected with a clip and illustrating the lateral adjustability of the joined pair.
Figure 5:
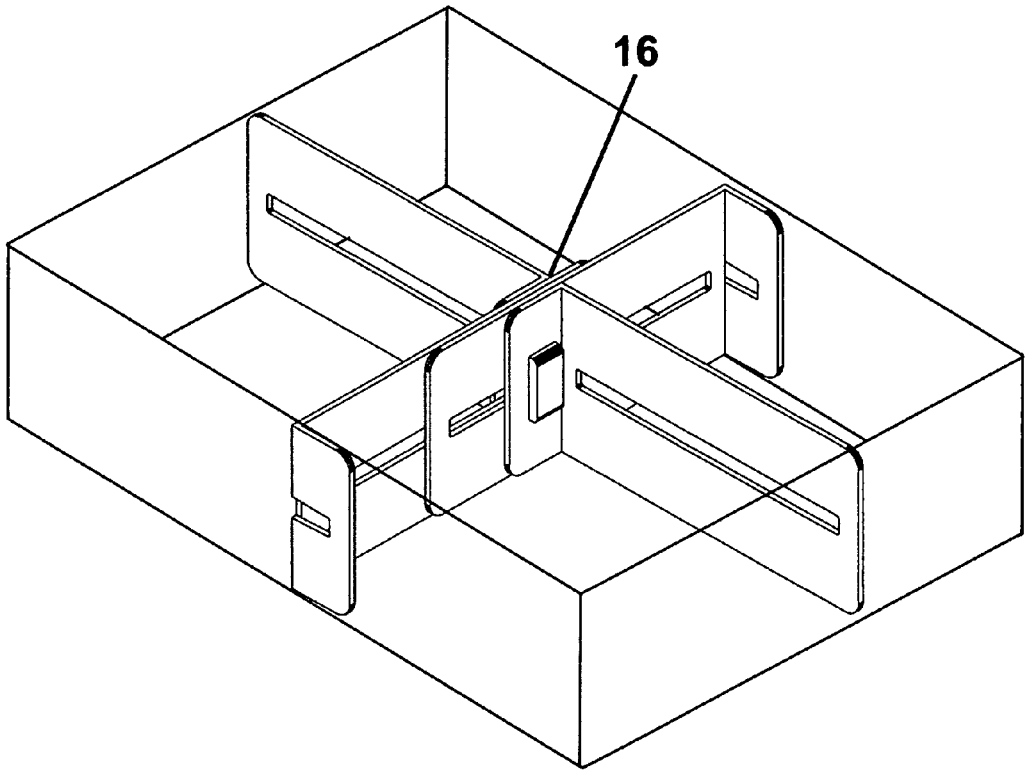
FIG. 5 is an angled perspective view of four dividers connected cross-sectional with a single clip shown in a drawer and illustrating the adjoining of multiple dividers in parallel or perpendicular orientation while continuing to provide for sectional adjustment by means of the lateral slots.

The drawer divider system includes divider panels FIGS. 2 and 3 that are connected together FIG. 4 by means of clips FIG. 1 to form sections within a drawer or the like or an area FIG. 5 of a construction that includes a bottom with attached side panels. The drawer divider system is used to create compartments within a given area by attaching dividers together, perpendicularly and/or parallel and/or expanding to a desired dimension FIG. 5.

To acquire a division of an area into a section, the divider panels FIGS. 2 and 3 may be attached together by placing a clip FIG. 1 through the slots 12, and 14 of each divider body and then may be expanded to the desired dimension FIG. 4. The panels in FIGS. 2 and 3 can be combined using like panels of the same length or differing sizes combined together to expand to the desired dimension.

A division of an area into a section may also be constructed by attaching one divider to another divider in a perpendicular orientation 16 by inserting a clip FIG. 1 through a flange 10 from one divider to the slot 12 and 14 of another divider.

The bifurcated clip FIG. 1 is designed and constructed of a polymer material that provides and retains tension and allows the repetitive insertion and removal of the clip from the divider body slot 12 and 14 and/or the divider flange slot 11. The clip is comprised of a bifurcated rectangular base and two protruding forks where the base 1 is a flat service with a rounded edge. The forks 2 and 3 are molded to the base 7 of the clip FIG. 1 in a perpendicular configuration. The design of the forks 2 and 3 and the taper 8 on the forks of the clip FIG. 1 provide tension and resistance to maintain a desired dimension when two or more connected dividers are expanded FIGS. 4 and 5. The gap 6 combined with the forks 2 and 3 and the taper 8 of the forks provide the outward tension and inward resistance necessary to join and secure the dividers. The tips of the forks 2 and 3 form a lip 4 and 5 to guide forks 2 and 3 during insertion into the slots 11, 12 and 14.

The flange of the divider FIGS. 2 and 3 provides an upright support for the divider and a means to connect additional dividers FIGS. 2 and 3 in a perpendicular manner FIG. 5. The lateral slot 11 of the flange 10 allows for the attachment of additional divider to form the perpendicular sides of a compartment division. The lateral slot 11 of the flange progressively narrows from the inner corner where the divider panel flange connects to the divider panel to the end of the slot.

The lateral slots running parallel along the length of the divider body FIG. 2 and 3 is implemented to allow the insertion of a clip FIG. 1 to attach dividers together in a perpendicular or parallel placement for dimensional versatility FIG. 5. The cross-lateral bridges 13 at the ends of the said slots provide divider structural integrity while allowing for flexibility during insertion and removal of clip.

Dividers are connected together parallel to each other a clip and then can functionally be expanded to a desired length. Additional divider sections can be added to other dividers to form additional compartments and divisions within an area by attaching the flange by the means of the clip to the main body slot of another divider FIG. 5. The divider can then be positioned along the main body of the divider panel by sliding the flange of the attached divider along the main body of the primary divider.

To form a cross section FIG. 5, four dividers can be attached together by using one clip FIG. 1. An expandable section as shown in FIG. 4 with two opposing divider sections attached perpendicular to the expandable section with a single clip connecting all four and providing tension to maintain stable cross section configuration. As sections or compartments are needed, additional dividers can be added.

The dividers and clips are constructed of highly flexible synthetic polymer material. This allows for all components of the divider system to be durable and flexible for easy removal and insertion of clips, and the connection and expansion of dividers for repeated configurations.

What is claimed is:

1. A divider system comprising a plurality of divider panels and one or more clips, wherein each divider panel has a slot extending substantially the length of the divider panel, a divider panel flange extending perpendicular from only one end of the divider panel and a slot of the same orientation as the divider panel slot within the divider panel flange, wherein the clips can be inserted through the slots to form compartments by attaching divider panels together with a clip extending through said slots, wherein a divider panel to a divider panel can be attached together through the slots with a clip to create an expandable divider system, wherein a divider panel flange to a divider panel flange can be attached together through the divider panel flange slots with a clip to extend the divider system length, wherein a divider panel flange slot to a divider panel slot can be attached together with a clip to form perpendicular compartments.

2. The divider system of claim 1, wherein said plurality of divider panels has a defined rectangular orientation of variable lengths and heights each divider panel is of a uniform thickness that extends the length of the divider panel and has a slot extending substantially the length of the divider panel for the insertion of clips where additional divider panels are attached forming compartments of variable dimensions.

3. The divider system of claim 1, wherein the clip is of a bifurcated design with two protruding forks perpendicular to a flat surface with a gap between the forks, wherein the forks provide the outward tension and inward resistance to securely hold the divider panels together, wherein the flat surface that extends on each side of the forks secures the clip to the divider panel and to the divider panel flange when the clip is inserted through the divider panel slot or the divider panel flange slot, wherein the fork ends are each tapered forming a lip to guide the clip insertion into the divider panel slot and into the divider panel flange slot to attach the divider panels together, wherein the length of the clip adjoins up to four divider panels on the forks in a cross-section configuration with the clip extending through two divider panel slots that are connected horizontally to form the expandable divider system and then the clip extending through two divider panel flange is ends of which one divider panel flange is connected on one side of the horizontally connected divider panels and the other divider panel flange connected on the opposite side of the horizontally connected divider panels where both divider panels are attached through the flange slots are at 90 degree angles perpendicular to the horizontal divider panels.

4. The divider system of claim 1, wherein the divider panels can be attached to each other using the clip and then expanding the two divider panels to the desired length wherein the divider panels are placed horizontally to each other, wherein the clip is inserted through the slot on the first divider panel and the same clip inserted through the slot on the second divider panel allowing the functionality where the divider panels remain connected and can expand up to the combined length of the slots of the divider panels minus the width of the clip.

5. The divider system of claim 1, wherein the slot within the length of divider panel, extending through the length of the divider panel but not extending to the end of the divider panel, allows the positioning and repositioning of an attached perpendicular divider panel to form compartments of varying dimensions and allows the resizing, sectioning and repositioning of the compartment by moving or sliding the clip along the divider panel slot, wherein the cup is placed through the flange of a divider panel and the same clip is place through the slot of another divider panel where the clip and the attached panel can easily be moved along the slot of said other divider panel.

6. The divider system of claim 1, wherein the divider panel flange that is connected at a 90 degree perpendicular orientation has a length shorter than the length of the divider panel wherein the divider panel flange provides for self sustaining upright orientation of a single divider panel and the divider panel flange functions as the means to attach divider panels together by inserting a clip through the slot of one divider panel then attaching the same clip through another divider panel flange slot thereby providing the means to attach divider panels together to form compartments.

7. The divider system of claim 1, wherein the divider panel flange slot opening progressively narrows from an inner corner where the divider panel flange connects to the divider panel towards the end of the divider panel flange slot, but not to the end of the divider panel flange, wherein the narrowing of the slot secures the clip from moving, providing the tension to secure the clip and the adjoining divider panels together.

* * * * *